US010864696B2

(12) United States Patent
Lammers et al.

(10) Patent No.: US 10,864,696 B2
(45) Date of Patent: Dec. 15, 2020

(54) DUNNAGE SYSTEM AND METHOD USING A COIL ACCUMULATOR

(71) Applicant: Ranpak Corp., Concord Township, OH (US)

(72) Inventors: Nico Lammers, Brunssum (NL); Erwin Methorst, Heerlen (NL); Reinhard L. M. H. Rothkranz, Voerendaal (NL)

(73) Assignee: Ranpak Corp., Concord Township, OH (US)

( * ) Notice: Subject to any disclaimer, the term of this patent is extended or adjusted under 35 U.S.C. 154(b) by 335 days.

(21) Appl. No.: 15/768,163

(22) PCT Filed: Oct. 24, 2016

(86) PCT No.: PCT/US2016/058462
§ 371 (c)(1),
(2) Date: Apr. 13, 2018

(87) PCT Pub. No.: WO2017/070670
PCT Pub. Date: Apr. 27, 2017

(65) Prior Publication Data

US 2018/0304571 A1 Oct. 25, 2018

Related U.S. Application Data

(60) Provisional application No. 62/245,648, filed on Oct. 23, 2015.

(51) Int. Cl.
*B31D 5/00* (2017.01)
*B65H 19/22* (2006.01)
(Continued)

(52) U.S. Cl.
CPC ..... *B31D 5/006* (2013.01); *B31D 5/0047* (2013.01); *B65H 19/2292* (2013.01);
(Continued)

(58) Field of Classification Search
CPC .. B65H 19/29; B65H 54/585; B65H 19/2292; B65H 2405/421; B65H 2301/41447;
(Continued)

(56) References Cited

U.S. PATENT DOCUMENTS 3,613,522 A * 10/1971 Johnson ..... B31D 5/0047 493/297
4,237,776 A * 12/1980 Ottaviano ..... B31D 5/0047 493/382
(Continued)

FOREIGN PATENT DOCUMENTS

CA 2900986 A1 8/2014
CN 102958815 A 3/2013
(Continued)

OTHER PUBLICATIONS

English Translation of Office Action for related Chinese National Phase Application No. 201680061883.4.
(Continued)

*Primary Examiner* — William A. Rivera
(74) *Attorney, Agent, or Firm* — Renner, Otto, Boisselle & Sklar, LLP

(57) ABSTRACT

A dunnage production system for producing coiled strips of dunnage includes a supply of strip-like dunnage, a coiler adjacent the supply and rotatable about a coiling axis for coiling a strip of the strip-like dunnage into a coil having a coiled configuration, and a tube aligned with the coiling axis. The tube has an internal diameter sized to receive the coil from the coiler in a discharge direction parallel to the coiling axis. The tube is capable of holding at least one coil in its coiled configuration until it is removed from the tube.

28 Claims, 10 Drawing Sheets

(51) Int. Cl.
*B65H 54/58* (2006.01)
*B65H 19/29* (2006.01)

(52) U.S. Cl.
CPC ..... *B65H 19/29* (2013.01); *B65H 54/585* (2013.01); *B31D 2205/007* (2013.01); *B31D 2205/0023* (2013.01); *B31D 2205/0035* (2013.01); *B31D 2205/0064* (2013.01); *B65H 2301/41447* (2013.01); *B65H 2301/418523* (2013.01); *B65H 2405/421* (2013.01); *B65H 2801/63* (2013.01)

(58) Field of Classification Search
CPC .... B65H 2301/418523; B65H 2801/63; B31D 5/006; B31D 5/0047; B31D 2205/0023; B31D 2205/0035; B31D 2205/0064; B31D 2205/007
See application file for complete search history.

(56) References Cited

U.S. PATENT DOCUMENTS 5,064,132 A 11/1991 Merz
5,468,525 A 11/1995 Watts
5,813,967 A * 9/1998 Davila ..... B31D 5/0047 493/464
6,168,559 B1 * 1/2001 Simmons ..... B26D 5/00 493/352
6,174,273 B1 * 1/2001 Harding ..... B31D 5/0047 493/24
6,626,813 B1 * 9/2003 Ratzel ..... B31D 5/006 493/464
7,803,100 B2 * 9/2010 Lu ..... B31D 5/0047 493/344
10,252,484 B2 * 4/2019 Winkens ..... B65H 19/30
2001/0017023 A1 * 8/2001 Armington ..... B65B 61/22 53/472
2008/0098699 A1 5/2008 Cheich et al.
2011/0281711 A1 * 11/2011 Chan ..... B31D 5/0043 493/464

FOREIGN PATENT DOCUMENTS

EP 0520420 A1 12/1992
JP H08267137 A 10/1996
JP 2013067428 A 4/2013
WO 95/14569 A1 6/1995
WO 2014/127061 A2 8/2014

OTHER PUBLICATIONS

Notification of the First Chinese Office Action for International Application No. PCT/US2016/058462 dated Mar. 5, 2019.
International Search Report and Written Opinion of the International Searching Authority for International Application No. PCT/US2016/058462.

* cited by examiner

DUNNAGE SYSTEM AND METHOD USING A COIL ACCUMULATOR

RELATED APPLICATIONS

This application is a national phase of International Patent Application No. PCT/US2016/58462 filed Oct. 24, 2016 and published in the English language, and which claims priority to U.S. Provisional Patent Application No. 62/245,648 filed Oct. 23, 2015, which are hereby incorporated herein by reference.

FIELD OF THE INVENTION

The present invention relates generally to a dunnage system and a method for making a coiled strip of dunnage, and more particularly to a system and method for making and accumulating one or more coiled strips of dunnage.

BACKGROUND

In the process of shipping one or more articles, products or other objects in a container, such as boxes or cartons, from one location to another, a protective packaging material or other type of dunnage material is typically placed in the shipping container to fill any voids, or to cushion the item during the shipping process. Converted paper dunnage material is an exemplary protective packaging material. The conversion may be accomplished by a conversion machine that converts a sheet stock material into a strip of relatively lower density dunnage.

For some applications, particularly when blocking or bracing a relatively larger or heavier item during shipping, the strip of dunnage may be "wound" into a coiled configuration to form a "coil" of dunnage. The coiled dunnage product then might be placed in the shipping container and the large/heavy item placed thereon, and another coiled dunnage product might be placed on top of the item, if necessary or desired. An exemplary system that includes a device, i.e., a coiler, for automatically forming a coil of dunnage is disclosed in commonly-owned U.S. Pat. No. 6,626,813, which is hereby incorporated herein by reference.

SUMMARY

The present invention provides an improved dunnage production system and method for coiling a strip of dunnage and storing the coiled strip until needed. Unlike prior dunnage coiling systems that used glue, tape, or staples to hold the coil in its coiled configuration, the improved system provided by the invention displaces, or pushes the coiled strip of dunnage from a coiler into a tube that holds the coiled strip of dunnage in its coiled configuration until it is removed from the tube and placed in a shipping container.

More particularly, the present invention provides a system for producing a coiled strip of dunnage that includes a supply of strip-like dunnage, a coiler adjacent the supply and rotatable about a coiling axis for coiling a strip of dunnage from the supply into a coiled configuration, and a tube aligned with the coiling axis. The tube has an internal diameter sized to receive coils from the coiler in a discharge direction parallel to the coiling axis. The tube is capable of receiving and holding at least one coiled strip of dunnage in the coiled configuration. The tube may have a cylindrical wall defining the internal diameter of the tube.

An end of the tube may at least partially surround the coiler to restrict access to the coiler. The system also may include a tube slide for moving the tube away from the coiler to improve access to the coiler, where the end of the tube is moveable between an operating position adjacent the coiler to a service position removed from the operating position. The system also may include a coiler lock to prevent displacement of the coiler when the tube is not in the operating position.

The system further may include a pusher moveable between a coiling position and a displaced position removed from the coiling position to axially displace the coiled strip of dunnage from the coiler into the tube. The pusher may be moveable along an axis axially aligned with the coiling axis. The pusher also may be moveable through at least a portion of the tube. A pusher slide may be located externally to the tube, such that the pusher moves along the pusher slide between the coiling position and the displaced position. A pusher actuator may be connected to the pusher to move the pusher from the coiling position to the displaced position. The system may include at least one sensor that detects when a strip of dunnage has been coiled, such that the pusher is actuated when a strip of dunnage has been coiled.

An exemplary system may include at least one sensor for detecting when the tube has moved away from the operating position. The sensor may detect when the coiled strip of dunnage has been axially displaced into the tube or when a predetermined number of coiled strips of dunnage are being held in the tube. The sensor also may detect when a coiled strip of dunnage is removed from the tube.

The system also may include a converter operable to convert a sheet stock material into the supply of strip-like dunnage, where the converter has an outlet for dispensing a strip of the strip-like dunnage in a downstream direction towards the coiler. The sheet stock material may be paper.

A coiler controller and a converter controller may be in communication with a sensor to activate the coiler and the converter, respectively, when the sensor indicates that the tube has capacity to receive a coiled strip of dunnage.

An exemplary tube further may include a coil tray adjacent the tube in the discharge direction for further holding and conveying of the coiled strip of dunnage from the tube. The coil tray may be an axially extending portion of the tube remote from the coiler.

The present invention also provides a system for producing a coiled strip of dunnage that includes means for supplying a strip-like dunnage, means for coiling a strip of the strip-like dunnage about a coiling axis, means for displacing the coiled strip of dunnage from the coiling means, and means for holding the coiled strip of dunnage in a coiled configuration. The coiling means may include a coiler having an axially extending fork rotatable about the coiling axis. The displacing means may include a pusher moveable between a coiling position and a displaced position removed from the coiling position to axially displace the coiled strip of dunnage from the coiling means to the holding means. The holding means may include a tube aligned with the coiling axis having an internal diameter sized to receive coils from the coiling means in a discharge direction parallel to the coiling axis, such that the tube receives and holds at least one coiled strip of dunnage in the coiled configuration. The supplying means may include a dunnage converter that converts sheet stock material into the strip-like dunnage.

The present invention also provides a method of producing coiled dunnage. The method includes the following steps: (1) coiling a strip of dunnage about a coiling axis and (2) axially displacing the coiled strip of dunnage into a tube to hold the coiled strip of dunnage in a coiled configuration.

The method further may include the steps of (3) detecting when the coiled strip of dunnage has been axially displaced, (4) detecting when a coiled strip of dunnage is removed from the tube, (5) coiling a strip of dunnage in response to a signal indicating that a coiled strip of dunnage has been removed from the tube, and (6) detecting when a predetermined number of coiled strips of dunnage are being held in the tube.

Even further, the method may include the steps of (7) controlling a converter operable to convert a sheet stock material into the strip-like dunnage in response to a signal indicating that the tube has capacity to receive a coiled strip of dunnage, and (8) controlling the coiling of the strip of dunnage in response to a signal indicating that the tube has capacity to receive a coiled strip of dunnage.

The foregoing and other features of the invention are hereinafter fully described and particularly pointed out in the claims, the following description and the annexed drawings setting forth in detail plural illustrative embodiments of the invention, such being indicative, however, of but a few of the various ways in which the principles of the invention may be employed.

DETAILED DESCRIPTION

Figure 1:
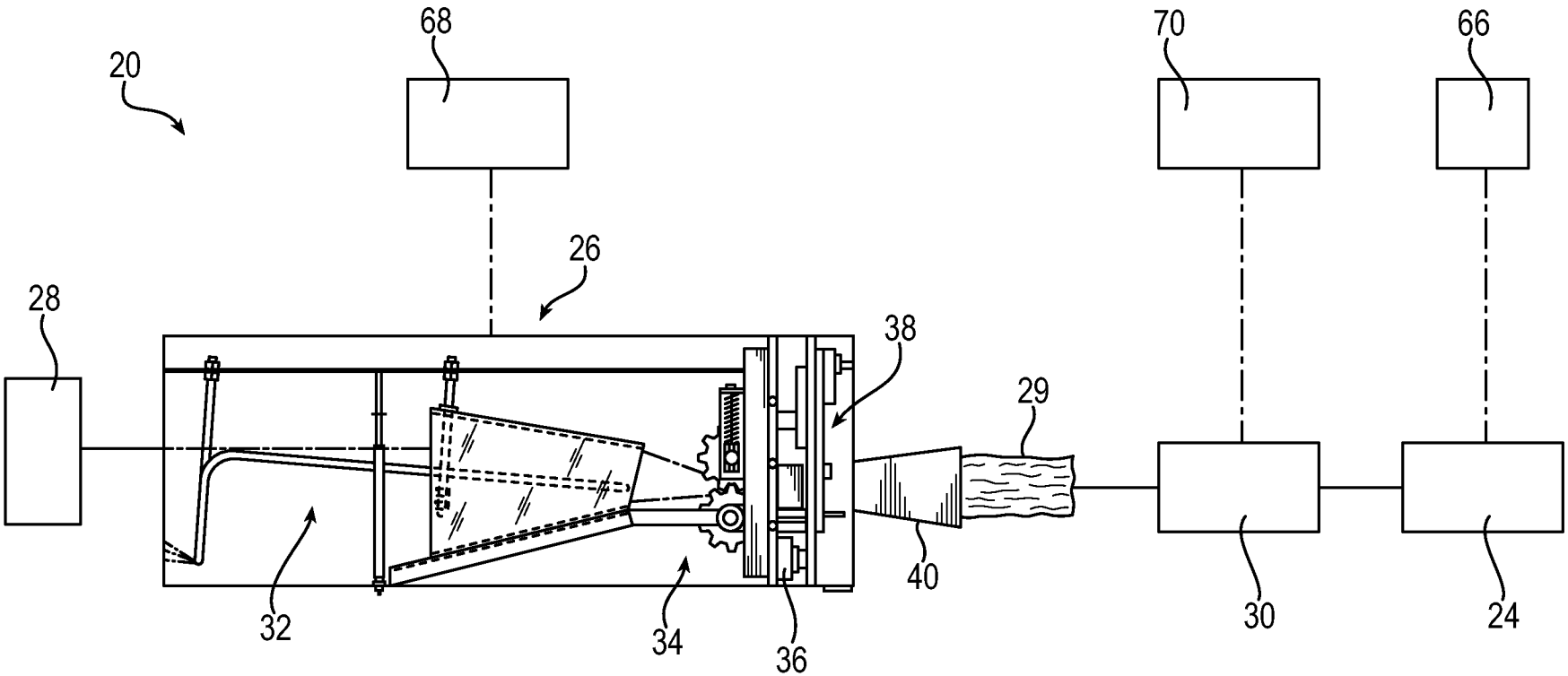
FIG. 1 is a schematic illustration of a dunnage production system in accordance with the present invention.

Referring now to the drawings in detail, and initially to FIG. 1, a schematic system for producing a coiled strip of dunnage according to the invention is indicated generally at 20. As is further described below, the system 20 produces a coiled strip of dunnage by coiling a strip of dunnage and then using a tube 24 to hold the coiled strip of dunnage in its coiled configuration until it is removed from the tube 24 to be placed in a shipping container (not shown). The tube 24 holds the coiled strip of dunnage in its coiled configuration without needing any glue, tape, staples, or other fastening means. Another advantage is that after the coiled strip of dunnage is used in the shipping container, the strip may be more easily removed and discarded without having to first remove and discard staples or tape.

An exemplary system 20 for producing a coiled strip of dunnage includes a supply of strip-like dunnage, such as a converter 26 operable to convert a sheet stock material 28 into a strip of relatively less dense dunnage 29, and a coiler 30 operable to coil the strip of dunnage 29 from the supply into a coiled configuration. Other types of dunnage and dunnage converters may be used, including other types of paper dunnage converters and plastic air pillow converters. The strip of dunnage is received by the coiler 30, which is positioned downstream of the converter 26 or other supply, to roll or wind the strip of dunnage into the coiled configuration. The finished coil is then displaced from the coiler 30 and moved into the tube 24 to hold it in its coiled configuration.

Exemplary dunnage converters are shown and described in U.S. Pat. No. 5,123,889 and in published International Patent Application No. PCT/US2001/018678, both of which are incorporated herein by reference. The illustrated converter 26 includes a conversion assembly 32 that pulls the sheet stock material 28 in a downstream direction and advances the stock material 28 from a supply through the converter 26, which converts the stock material 28 into a relatively lower density strip of dunnage. The supply of sheet stock material 28 generally is provided in a compact configuration, such as a roll of stock material or a generally rectangular stack of fan-folded stock material. The sheet stock material 28 may be paper, such as kraft paper, although the system and method provided by the invention could use other types of sheet material, such as plastic sheet material convertable into a strip of air-filled bags. Additionally, the sheet stock material 28 may be single ply or have multiple plies.

The illustrated conversion assembly 32 includes a feeding/connecting assembly 34 that pulls the sheet stock material 28 through a forming assembly 36. The forming assembly 36 randomly crumples the sheet material and inwardly guides lateral edges of the sheet material before the feeding/connecting assembly 34 connects overlapping layers of the crumpled sheet so that the strip of dunnage holds its crumpled strip-like shape. The converter 26 also includes a severing assembly 38 for severing the completed strip of dunnage 29, once a desired length has been produced. The strip of dunnage 29 exits the converter through a discharge chute 40 which forms the outlet of the converter 26.

Figure 2:
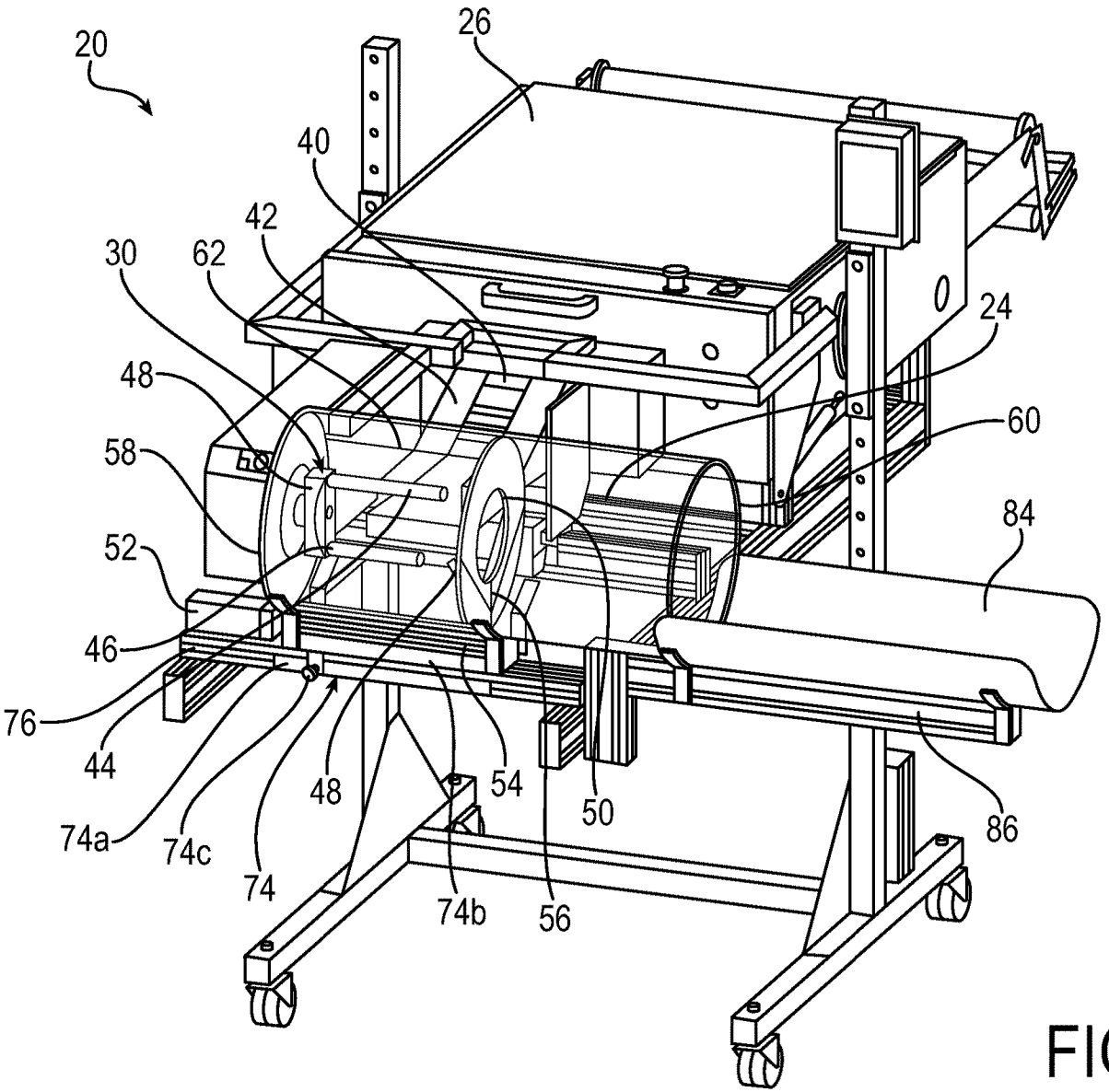
FIG. 2 is a perspective view of an exemplary dunnage production system in accordance with the present invention.
Figure 3:
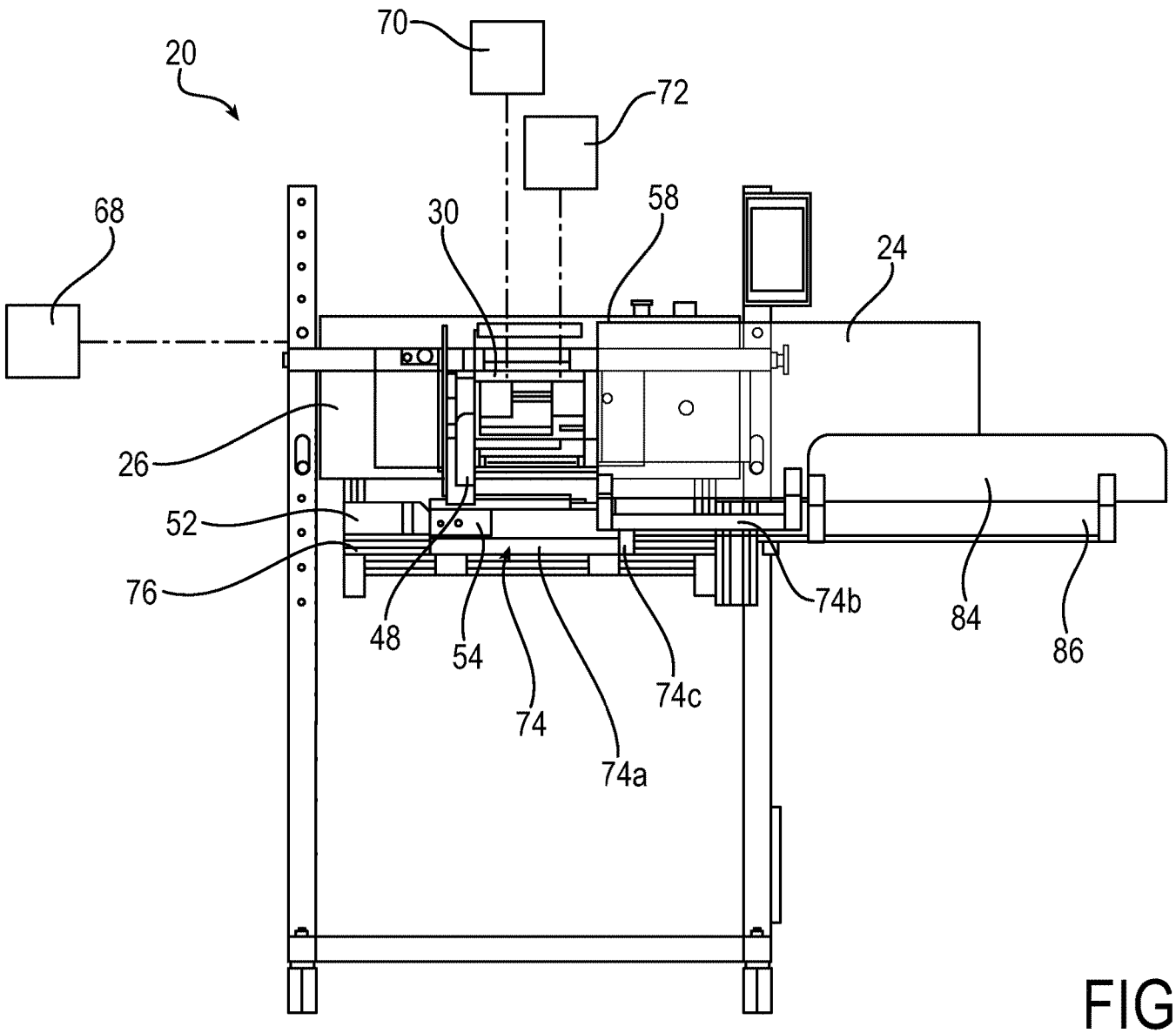
FIG. 3 is a front elevation view of the system of FIG. 2.

A coiler 30 is positioned downstream of the converter 26 to receive the strip of dunnage from the outlet 40, as shown in FIGS. 2 and 3. The system 20 may include guide members 42 that define a guide path from the outlet 40 downstream to the coiler 30. The guide path defines the downstream travel of the strip of dunnage and guides the body of the strip to be received and coiled by the coiler 30. The strip of dunnage exits the outlet 40 of the converter 26, and as a leading end of the strip reaches the coiler 30, the leading end of the strip passes between a pair of coiler forks 44 that receive the strip. The coiler 30 rotates the forks 44 and winds the strip about a coiling axis that is parallel to the forks 44 as the strip continues to exit the converter 26. The coiler forks 44 extend perpendicular to the downstream direction such that the coiling axis is perpendicular to the downstream direction. The coiler forks 44 have ends 46 that are fixed to a rotatable base 48 of the coiler 30. When the coiling of the strip is completed, the forks 44 may continue to rotate until the trailing end of the strip is free of the outlet 40. The coiler 30 may include a coil ejector for displacing the completed coil from the coiler forks 44 toward the tube 26 or into the tube 26.

In the illustrated system 20, the coil ejector includes a moveable pusher 48 for axially displacing the coiled strip of dunnage from the coiler 30 into the tube 24 in a discharge direction. The discharge direction is parallel to the coiling axis and transverse to the downstream direction. The pusher 48 is initially in a coiling position near the ends 46 of the coiler forks 44 and the base 48 of the coiler 30 while the coiler 30 is coiling the strip about the coiling axis. After the coiler 30 has coiled the strip, the pusher 48 is moveable to a displaced position removed from the coiling position to axially displace the coiled strip into the tube 24 in the discharge direction. In the illustrated embodiment, the pusher 48 has a disc-shaped body with a circular aperture 50 through which the coiler forks 44 extend as the pusher 48 moves in the discharge direction from the coiling position to the displaced position.

The pusher 48 is moveable between the coiling position and the displaced position by a pusher actuator 52 connected to the pusher 48 to move the pusher 48 in the discharge direction. The pusher actuator 52 moves the pusher 48 along a pusher slide 54 extending in the discharge direction. The disc-shaped body portion of the pusher 48 extends perpendicular to the pusher slide 54. A bracket 56 fixed to the disk body of the pusher 48 supports the pusher 48 for movement along the pusher slide 54. The illustrated pusher slide 54 is located externally to the tube 24 and parallel to the coiling axis, but the pusher 48 may be moveable through at least a portion of the tube 24 or through the entire tube 24.

Figure 4:
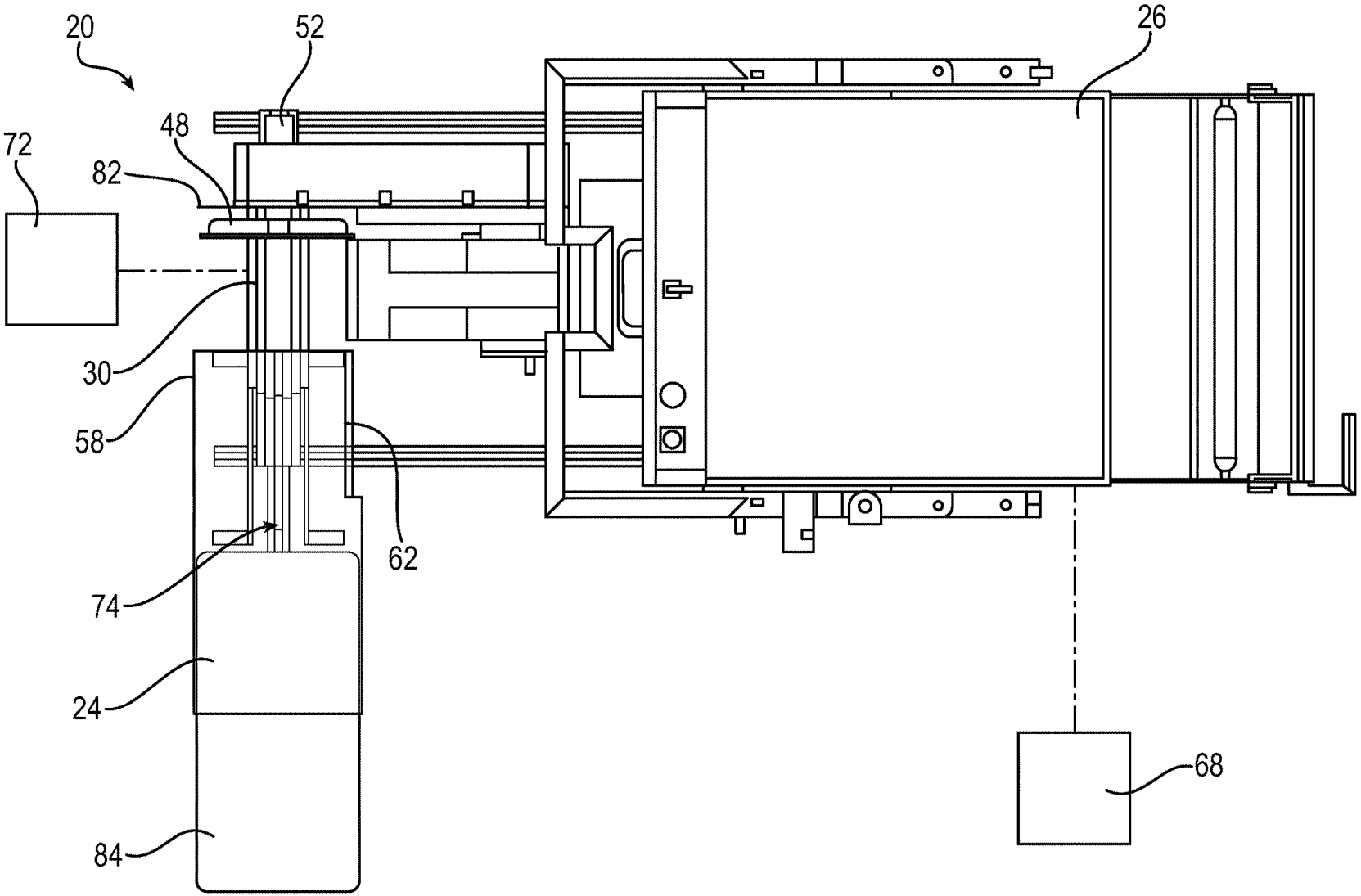
FIG. 4 is a top elevation view of the system of FIG. 2.
Figure 5:
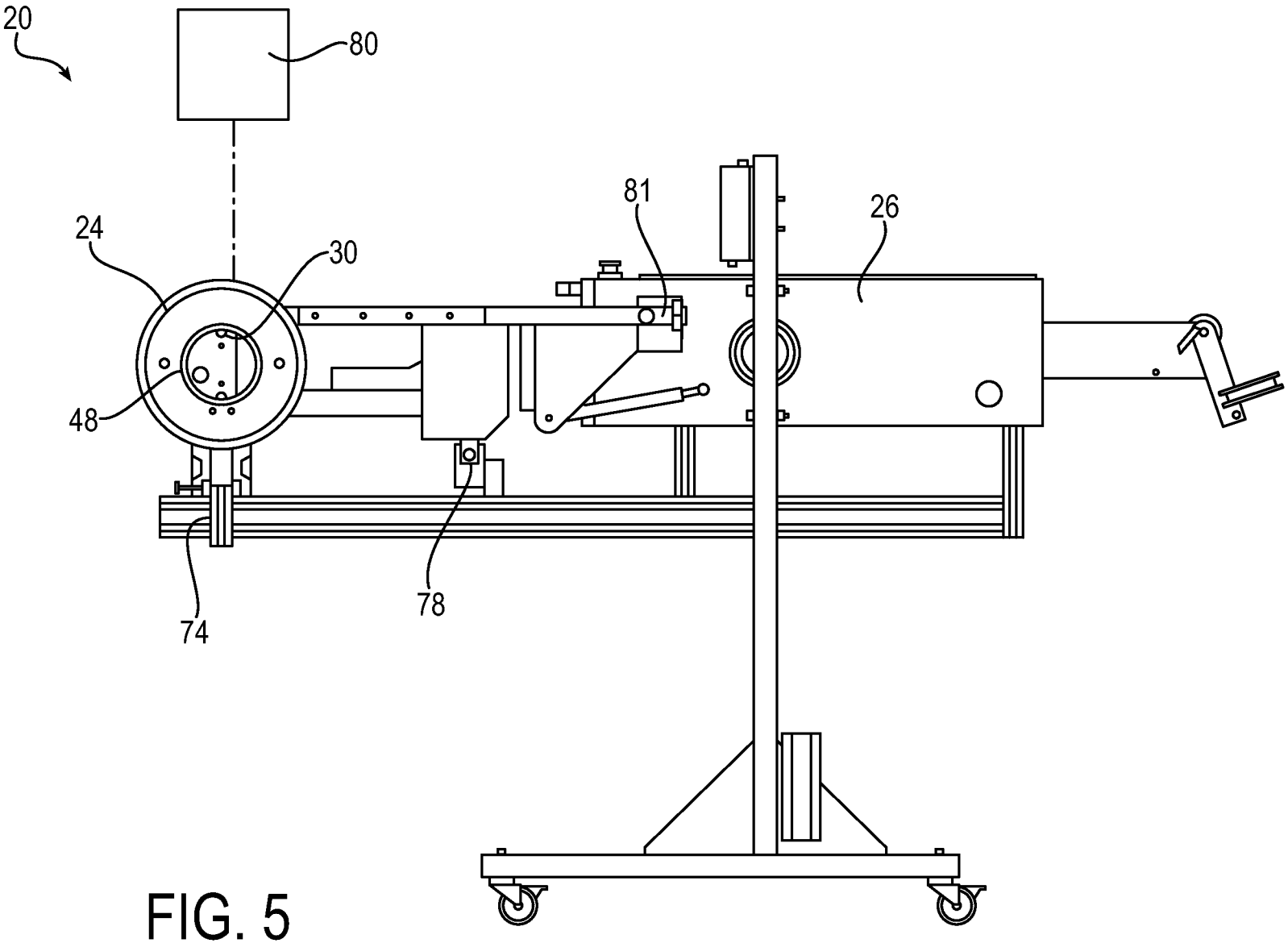
FIG. 5 is a side elevation view of the system of FIG. 2.

Referring in addition to FIGS. 4 and 5, the tube 24 is positioned downstream from the converter 26 and adjacent the coiler 30. The illustrated tube 24 defines a longitudinal axis parallel to the coiling axis that may be coextensive with the coiling axis such that the coiled strip of dunnage is coiled about the same axis along which it is axially displaced. The tube 24 is positioned to receive the coiled strip after the finished coil has been axially displaced from the coiler 30 and holds the strip in its coiled configuration. The tube 24 has a first end 58 and a second end 60 spaced from the coiler 30 and the first end 58, and portions extending between the first end 58 and the second end 60 for holding the coiled strips in their coiled configuration when between the first end 58 and the second end 60.

In the illustrated embodiment, the first end 58 of the tube 24 surrounds the coiler 30 as in FIG. 2, where the coiler 30 rotates and coils the strip within the tube 24. The tube 24 at least partially surrounds the coiler 30 to restrict access to the coiler 30 during operation.

The illustrated tube 24 has a strip-receiving passage 62 at the first end 58 of the tube 24, as best shown in FIGS. 2 and 4. The strip-receiving passage 62 generally is aligned with and downstream of the outlet 40 of the converter 26. The coiler 30 is adjacent the strip-receiving passage 62 such that the coiler 30 is further downstream from the converter 26 than the strip-receiving passage 62. The strip receiving passage 62 is dimensioned to allow the lead end of the strip of dunnage to pass through the passage 62 and engage the coiler forks 44 within the tube 24. When the body of the strip is coiled and completed, the pusher 48 is moveable from the first end 58 of the tube 24 toward the second end 60. The pusher 48 is located at the first end of the tube 60 when initially in the coiling position and moves towards the second end 60 when in the displaced position to move the coiled strip toward the second end 60 of the tube 24. The tube 24 holds the coiled strip in the coiled configuration until the coiled strip is removed from the tube 24. The tube 24 may hold more than one coiled strip during operation of the system 20.

In another exemplary embodiment of the tube 24, the tube 24 may be located adjacent to but spaced from the coiler 30 along the discharge direction when in the operating position, such that the coiler 30 coils the strip of dunnage outside of the tube 24. After completion of the coiled strip, the pusher 48 pushes the coiled strip of dunnage into the first end 58 of the tube 24 in the discharge direction. As more strips are coiled and pushed into the tube 24, the strips at the first end 58 of the tube 24 are pushed towards the second end 60 of the tube 24 by the coil being displaced into the first end 58 of the tube 24. The tube 24 is elongated to hold a predetermined number of coiled strips, allowing a plurality of coiled strips to be produced and held in the coiled configuration until they are removed.

Figure 8:
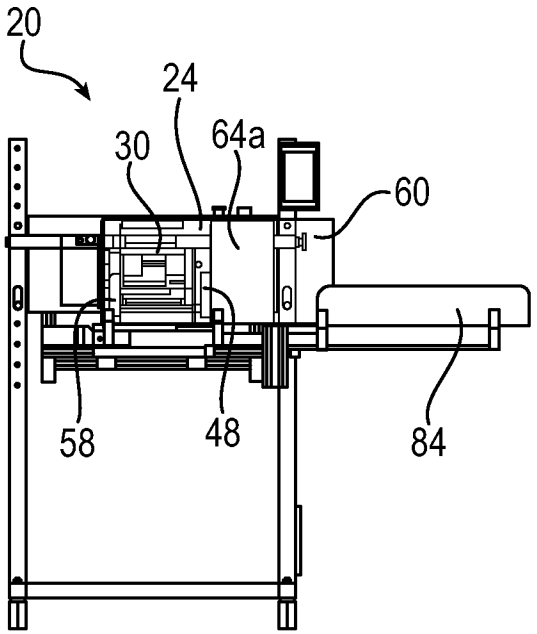
FIG. 8 is a front elevation view of the system of FIG. 7 with the displaced first coiled strip of dunnage.
Figure 7:
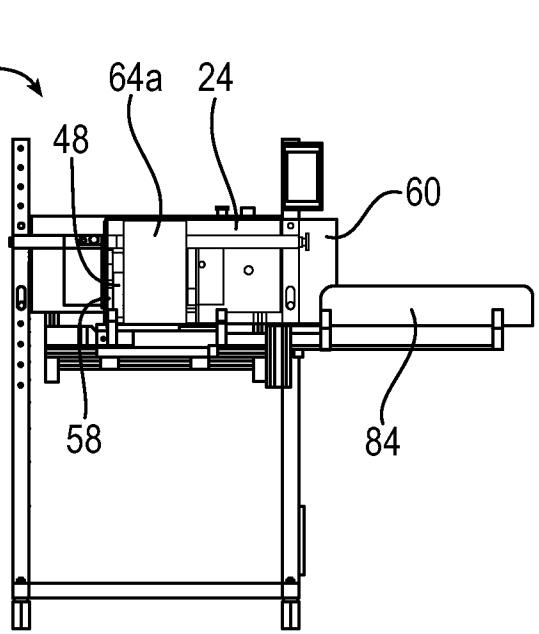
FIG. 7 is a front elevation view of the system of FIG. 6 with a first coiled strip of dunnage.
Figure 6:
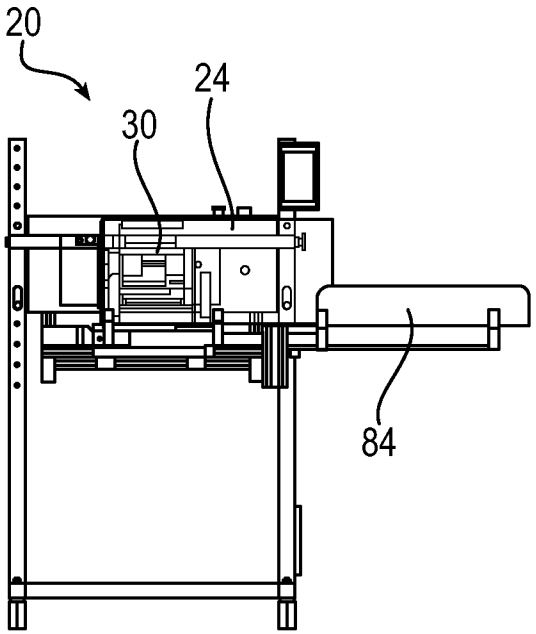
FIG. 6 is a front elevation view of the system of FIG. 2 in an initial position.

The steps of the system 20 producing and holding each of the plurality of coiled strips in their coiled configuration are shown in FIGS. 6 to 14. FIG. 6 shows the system 20 with the coiler 30 and the tube 24 before a strip of dunnage has been coiled and displaced to be held in the tube 24. FIG. 7 shows a first coiled strip of dunnage 64*a* produced and located at the first end 58 of the tube 24 and the pusher 48 in the coiling position before displacing the coiled strip 64*a*. FIG. 8 shows the system 20 after the first coiled strip 64*a* has been displaced by the pusher 48 from the first end 58 toward the second end 60 of the tube 24 in the discharge direction. The pusher 48 is in the displaced position removed from the coiling position.

Figure 11:
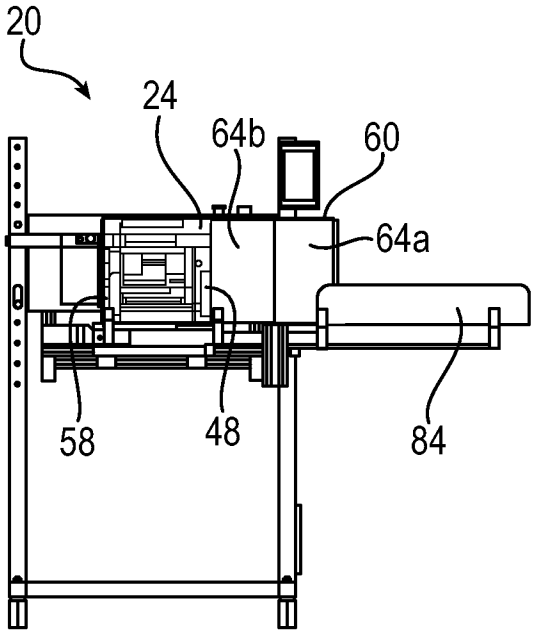
FIG. 11 is a front elevation view of the system of FIG. 10 with the displaced second coiled strip of dunnage.
Figure 10:
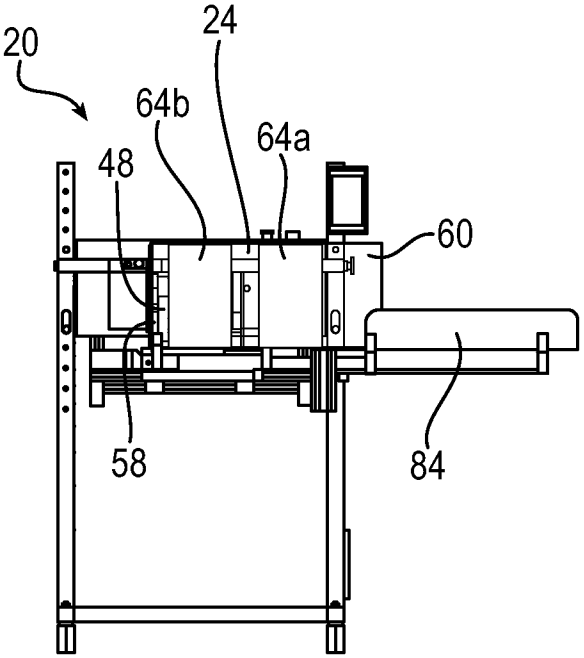
FIG. 10 is a front elevation view of the system of FIG. 9 with a second coiled strip of dunnage.
Figure 9:
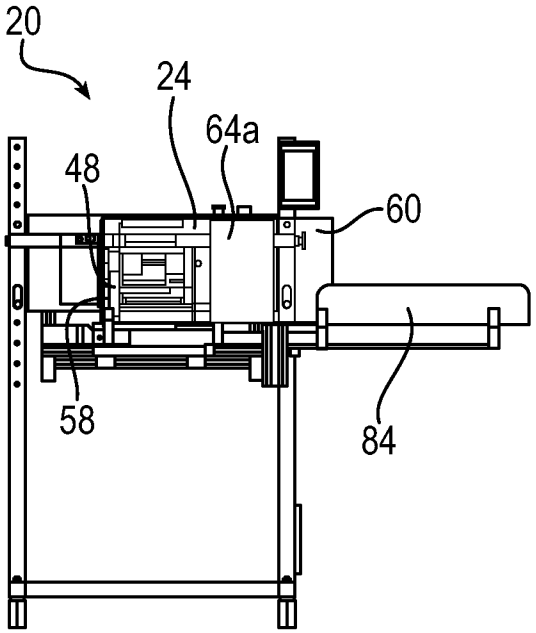
FIG. 9 is a front elevation view of the system of FIG. 8 in the initial position with the displaced first coiled strip of dunnage.
Figure 14:
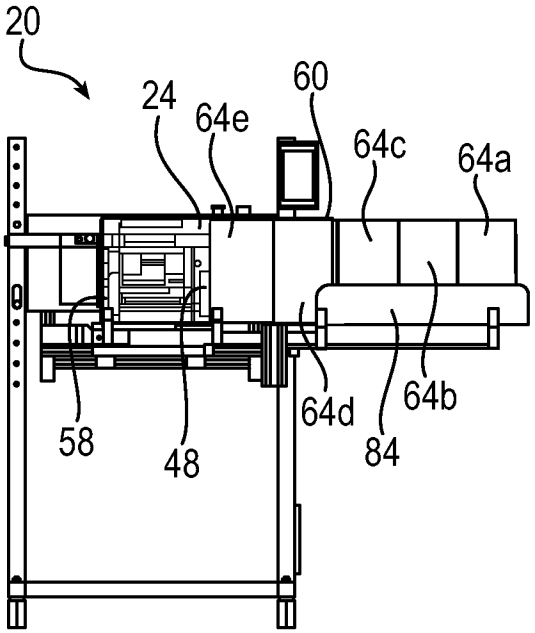
FIG. 14 is a front elevation view of the system of FIG. 13 with five coiled strips of dunnage.
Figure 13:
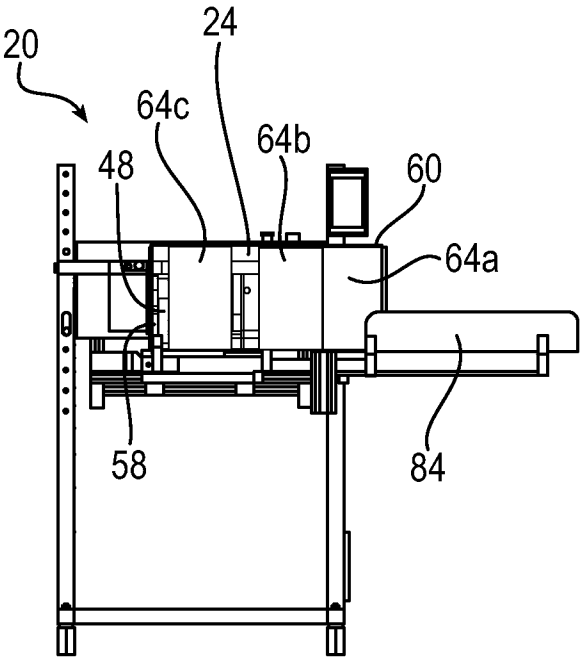
FIG. 13 is a front elevation view of the system of FIG. 12 with a third coiled strip of dunnage.
Figure 12:
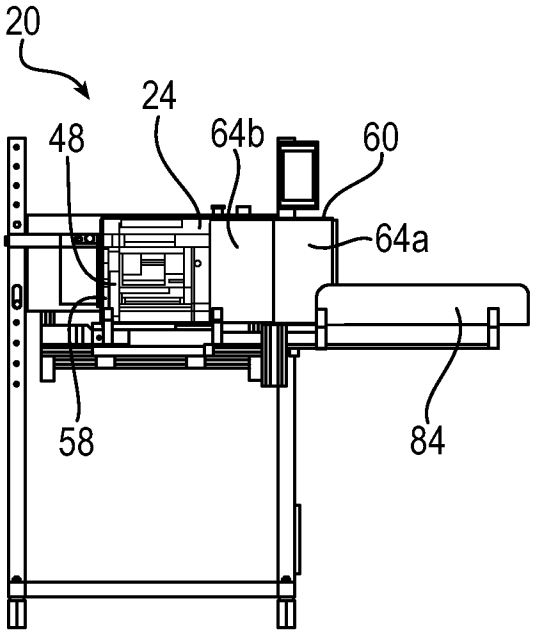
FIG. 12 is a front elevation view of the system of FIG. 11 in the initial position with the displaced second coiled strip of dunnage.

FIG. 9 shows the pusher 48 returned to the coiling position after having displaced the first coiled strip 64*a*. FIG. 10 shows a second produced coiled strip 64*b* located at the first end 58 of the tube 24, while the first coiled strip 64*b* is held at the second end 60 of the tube 24. The pusher 48 is in the coiling position. FIG. 11 shows the system 20 after the second coiled strip 64*b* has been displaced by the pusher 48 from the first end 58 toward the second end 60, adjacent the first coiled strip 64*a*. The pusher 48 is in the displaced position. The second coiled strip 64*b* slightly pushes the first coiled strip 64*a* further through the tube 24 in the discharge direction. FIG. 12 shows the pusher 48 returned to the coiling position after having displaced the second coiled strip 64*b*. FIG. 13 shows a third coiled strip 64*c* to be displaced by the pusher 48 and held by the tube 24. FIG. 14 shows a fourth and fifth coiled strip of dunnage 64*d*, 64*e* produced and displaced by the pusher 48 into the tube 24 to be held in the coiled configuration.

The system 20 may include control elements that facilitate producing and holding a plurality of coiled strips of dunnage in the coiled configuration. As shown in FIG. 1, the control elements include at least one sensor 66 associated with the tube 24. The at least one sensor 66 may include a sensor for detecting when a coiled strip of dunnage has been axially displaced into the tube 24 or when a predetermined number of coiled strips are being held in the tube 24. The at least one sensor 66 may include a sensor for detecting when a coiled strip is removed from the tube 24. The at least one sensor 66 may be in communication with at least one of a converter controller 68 and a coiler controller 70. If connected to the converter controller 68, the converter controller 68 may activate the converter 26 when the sensor 66 indicates that the tube 24 has capacity to receive a coiled strip of dunnage. If connected to the coiler controller 70, the coiler controller 70 activates the coiler 30 when the sensor 66 indicates that the tube 24 has capacity to receive a coiled strip of dunnage. The control elements of the system 20 allow the system 20 to produce and hold a plurality of coiled strips in their coiled configuration based on a pre-determined capacity of the tube 24.

The control elements further may include a sensor 72 that detects when a strip of dunnage has been coiled by the coiler 30, as shown in FIG. 3. The pusher 48 may be actuated as previously described in response to the sensor 72 indicating that the strip has been coiled. The pusher actuator 52 may actuate the pusher 48 in response to the sensor 72 to displace the coiled strip of dunnage in the discharge direction.

When the system 20 is not in operation, or at rest, the tube 24 typically has a service position removed from its operating position to allow maintenance to be performed on the coiler 30 or other components of the system 20 that may be normally inaccessible due to the position of the tube 24. FIG. 2 shows the tube 24 in the operating position where the first end 58 of the tube 24 surrounds the coiler 30 and prevents access to the coiler 30. FIGS. 3 and 4 show the tube 24 in the service position where the tube 24 is removed from the operating position and the first end 58 is removed from surrounding the coiler 30, allowing access to the coiler 30. As shown in FIGS. 2 to 4, the tube 24 is moveable between the operating position and the service position removed from the operating position through movement along a tube slide 74 which may extend in the discharge direction.

The illustrated tube slide 74 is located outside the tube 24 and parallel to the coiling axis, as best shown in FIGS. 2 and 3. The tube slide 74 includes a fixed track 74*a* and a moveable track 74*b* fixed to an exterior surface of the tube 24. The moveable track 74*b* is moveable relative to the fixed track 74*a* for displacing the tube 24 from the coiler 30. The tube slide 74 may include a slide lock 74*c* that prevents movement of the moveable track 74*b* relative to the fixed track 74*a* during operation of the system 20, as in FIG. 2, or during transportation of the system 20. The slide lock 74*c* may be unlocked to allow the moveable track 74*b* and the tube 24 to axially move away from the coiler 30, as in FIG. 3. The tube slide 74 may be supported by a track 76 that also supports the pusher slide 54, along which the pusher 48 moves between its coiling position and its displaced position to displace the completed coiled strip of dunnage. The track 76 is configured to support the pusher slide 54 and the tube slide 74 while allowing the pusher 48 and the tube 24 to move along their respective slides independent of one another.

Referring in addition to FIG. 5, when the tube 24 is displaced along the tube slide 74 away from the operating position or when the tube 24 is in the service position removed from the operating position, the system 20 may include a coiler arm lock 78 to prevent displacement of the coiler 30. To unlock the coiler arm lock 78 and to allow movement of the arm of the coiler 30 for maintenance or replacing the arm, the system 20 may include a sensor 80 that detects when the first end 58 of the tube 24 is not in the operating position. The sensor 80 also may include a sensor to detect when the pusher 48 is in the displaced position away from the coiler 30. When the sensor 80 indicates that the tube 24 and the pusher 48 are removed from the coiler 30, the coiler arm lock 78 is unlocked to allow movement of the arm of the coiler 30.

The coiler arm lock 78 thus improves upon previous coiler arm locks by providing an additional locking function. Previous coiler arm locks were used to secure the coiler forks 44 in a locked position and could be unlocked at any time. The coiler arm lock 78 provided by the invention will not unlock until the sensor 80 indicates that the tube 24 is removed from the coiler 30. The system 20 also may include a secondary coiler arm lock 81 similar to previously coiler arm locks. Thus, when the sensor 80 indicates that the tube 24 is removed from the coiler 30, the coiler arm lock 78 automatically unlocks and the secondary coiler arm lock 81 also has to be unlocked in the conventional manner, providing a backup.

Figure 15:
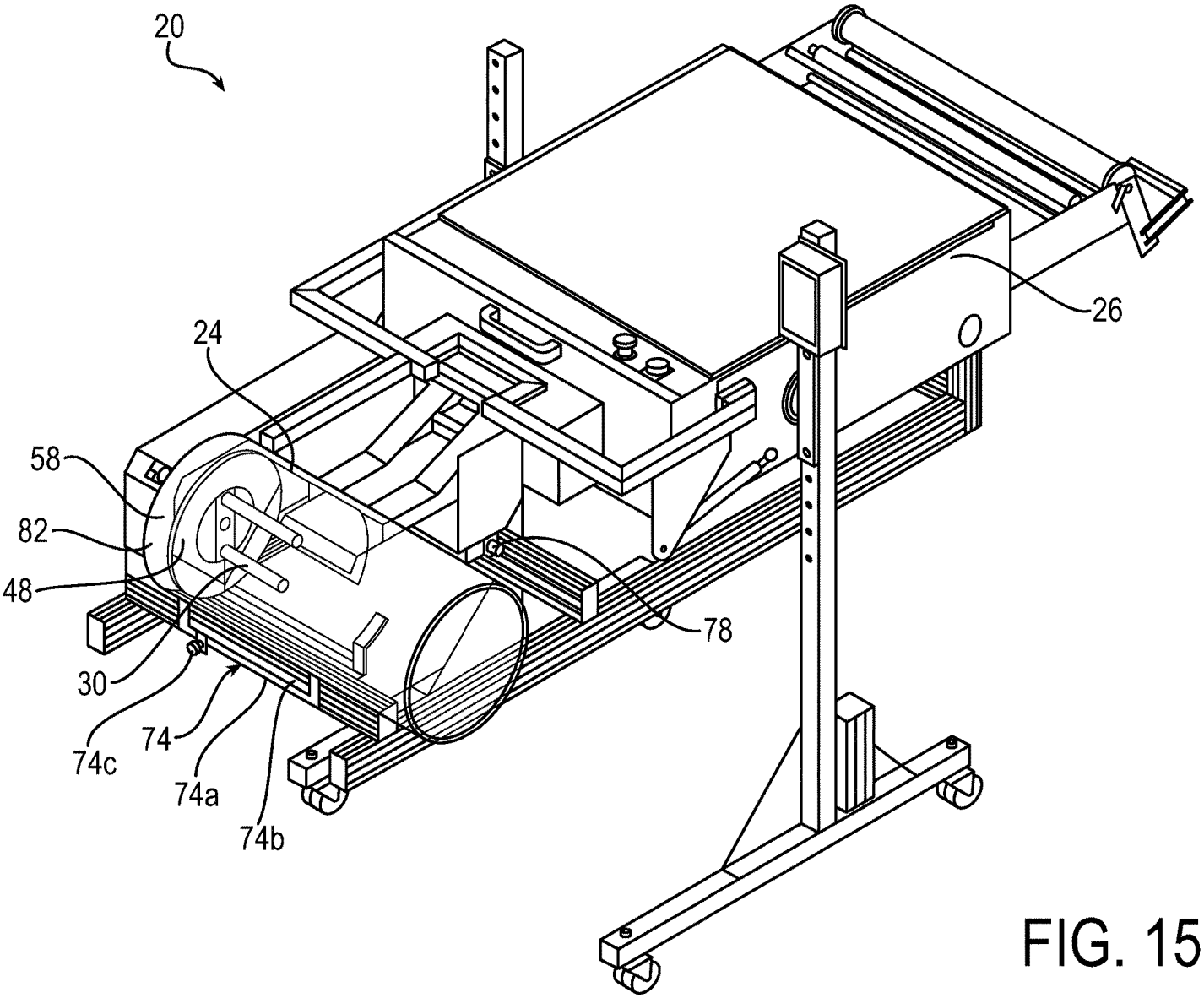
FIG. 15 is a perspective view of another exemplary embodiment of the dunnage production system in accordance with the present invention.

Aside from maintenance, the system 20 can be locked during transportation of the system 20. As shown in FIG. 15, during transportation of the system 20, the tube 24 is positioned such that the second end 58 of the tube 24 surrounds the coiler 30 and prevents access to the coiler 30. Locking the coiler arm lock 78 also prevents displacement of the coiler 30. The pusher 48 is in its coiling position and is not operable to move to its displaced position. The slide lock 74*c* of the tube slide 74 is locked such that both the moveable track 74*b* and the tube 24 fixed to the moveable track 74*b* are prevented from moving relative to the fixed track 74*a*. The converter 26 may include a tube guard 82. As best shown in FIG. 4, when the tube 24 is in its displaced position, the first end 58 moves with the tube 24. The tube guard 82 does not move with tube 24, however, and maintains its original position. The tube guard 82 cooperates with the tube 24 to prevent access to the coiler 30 while it is rotating to coil a strip of dunnage.

The exemplary system 20 shown in FIGS. 2 to 4 and FIGS. 6 to 14 further includes an optional coil tray 84 adjacent to and extending from the second end 60 of the tube 20 in the discharge direction for further holding the coiled strip of dunnage in its coiled configuration after the coiled strip has left the tube 24. The coil tray 84 is supported on a bracket 86 attached to mounting components of the system 20 and extending parallel to the longitudinal axis of the tube 20. The coil tray 84 may be used to receive coiled strips that have been pushed out of the tube 24 due to the number of coiled strips in the tube 24 exceeding the holding capacity of the tube 24. The coil tray 84 is semi-circular and has approximately the same diameter as the tube 24, partially surrounding a coiled strip supported on the coil tray 84. The coil tray 84 may hold a plurality of coiled strips until the coiled strips are removed. An advantage of using the coil tray 84 in addition to the tube 24 is that the coil tray 84 allows easier access to remove the coiled strips while still tending to hold the coiled strips in the coiled configuration after the coiled strips leave the tube 24 without needing any glue, tape, staples, or other fastening means.

Figure 16:
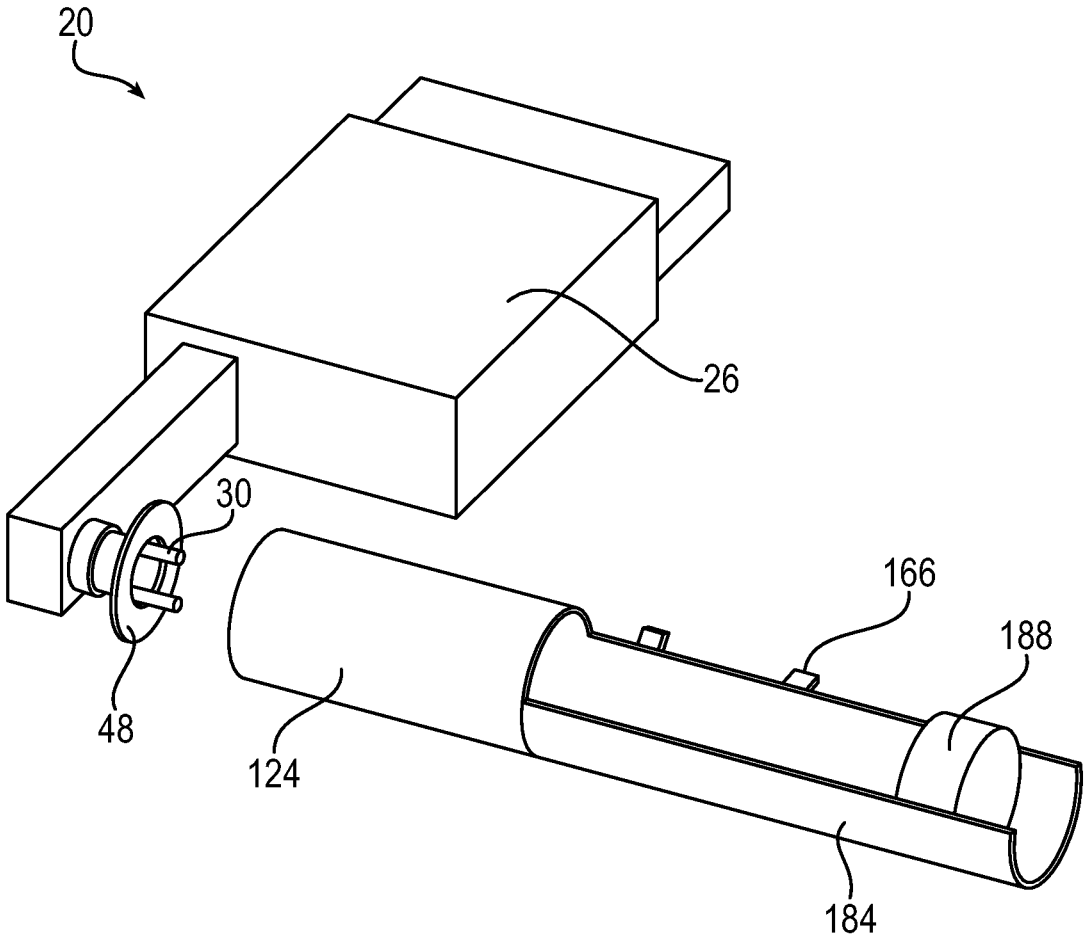
FIG. 16 is a perspective view of yet another exemplary embodiment of the dunnage production system.

An exemplary coil tray 184 is formed as an integral extension of the tube 124 shown in FIG. 16. The coil tray 184 allows easier access during removal of the coiled strip from the tube 124. The illustrated tube 124 may be used in the system 20 as previously described. The tube 124 may include a sensor 166. The sensor 166 detects the position of a coiled strip 188 within the tube 124 or the coil tray portion 184 of the tube 124. The sensor 166 may detect when the coiled strip 188 is removed from the tube 124. The sensor 166 may be in communication with at least one of the converter 26 and the coiler 30 such that the converter 26 and the coiler 30 may be activated when the sensor 166 indicates that one of the tube 124 or coil tray portion 184 has capacity to receive another coiled strip.

The present invention also provides a method of producing coiled dunnage that includes the steps of (1) coiling a strip of dunnage about a coiling axis, and (2) axially displacing the coiled strip of dunnage into a tube to hold the coiled strip of dunnage in a coiled configuration. The method further may include the steps of (3) detecting when the coiled strip of dunnage has been axially displaced, (4) detecting when a predetermined number of coiled strips of dunnage are being held in the tube, and (5) detecting when a coiled strip of dunnage is removed from the tube. The method further may include the step of (6) coiling a strip of dunnage in response to a signal indicating that a coiled strip of dunnage has been removed from the tube. The method further may include the steps of (7) controlling a converter operable to convert a sheet stock material into the strip of dunnage, and (8) controlling the coiling of the strip of dunnage in response to a signal indicating that the tube has capacity to receive a coiled strip of dunnage.

In summary, the present invention provides a dunnage production system 20 for producing coiled strips of dunnage that includes a supply of strip-like dunnage 29, a coiler 30 adjacent the supply 29 and rotatable about a coiling axis for coiling a strip of the strip-like dunnage 29 into a coil having a coiled configuration, and a tube 24 aligned with the coiling axis. The tube 24 has an internal diameter sized to receive coils from the coiler 30 in a discharge direction parallel to the coiling axis. The tube 24 is capable of holding at least one coiled strip of dunnage in its coiled configuration until it is removed from the tube 24.

Although the invention has been shown and described with respect to certain embodiments, equivalent alterations and modifications will occur to others skilled in the art upon reading and understanding this specification and the annexed drawings. In particular regard to the various functions performed by the above described integers (components, assemblies, devices, compositions, etc.), the terms (including a reference to a "means") used to describe such integers are intended to correspond, unless otherwise indicated, to any integer which performs the specified function of the described integer (i.e., that is functionally equivalent), even though not structurally equivalent to the disclosed structure which performs the function in the herein illustrated exemplary embodiments of the invention. In addition, while a particular feature of the invention may have been described above with respect to only one of several illustrated embodiments, such feature may be combined with one or more other features of the other embodiments, as may be desired and advantageous for any given or particular application.

The invention claimed is:

1. A system for producing a coiled strip of dunnage, comprising:

a supply of strip-like dunnage;

a coiler adjacent the supply, the coiler including a coiling mechanism configured to engage the strip of dunnage, and the coiling mechanism is rotatable about a coiling axis for coiling a strip of dunnage from the supply into a coiled configuration; and a tube aligned with the coiling axis having an internal diameter sized to receive coils from the coiler in a discharge direction parallel to the coiling axis, the tube having a length dimension parallel to the coiling axis that is greater than a length of the coiling mechanism parallel to the coiling axis, whereby the tube is capable of receiving and holding at least one coiled strip of dunnage in the coiled configuration.

2. A system as set forth in claim 1, wherein an end of the tube at least partially surrounds the coiler to restrict access to the coiler.

3. A system as set forth in claim 1, further comprising a tube slide for moving the tube away from the coiler to improve access to the coiler, where the end of the tube is moveable between an operating position adjacent the coiler to a service position removed from the operating position.

4. A system as set forth in claim 3, further comprising a coiler lock preventing displacement of the coiler when the tube is not in the operating position.

5. A system as set forth in claim 3, further comprising at least one sensor detecting when the tube has moved away from the operating position.

6. A system as set forth in claim 1, further comprising a pusher moveable between a coiling position and a displaced position removed from the coiling position to axially displace the coiled strip of dunnage from the coiler into the tube.

7. A system as set forth in claim 6, further comprising a pusher actuator connected to the pusher to move the pusher from the coiling position to the displaced position.

8. A system as set forth in claim 7, further comprising at least one sensor that detects when a strip of dunnage has been coiled, wherein the pusher is actuated when a strip of dunnage has been coiled.

9. A system as set forth in claim 6, wherein the pusher is moveable along an axis axially aligned with the coiling axis.

10. A system as set forth in claim 6, wherein the pusher is moveable through at least a portion of the tube.

11. A system as set forth in claim 6, further comprising a pusher slide located externally to the tube, wherein the pusher moves along the pusher slide between the coiling position and the displaced position.

12. A system as set forth in claim 1, further comprising at least one sensor for detecting when the coiled strip of dunnage has been axially displaced into the tube.

13. A system as set forth in claim 12, wherein the at least one sensor includes a sensor for detecting when a predetermined number of coiled strips of dunnage are being held in the tube.

14. A system as set forth in claim 1, further comprising at least one sensor for detecting when a coiled strip of dunnage is removed from the tube.

15. A system as set forth in claim 14, further comprising a coiler controller in communication with the at least one sensor to activate the coiler when the sensor indicates that the tube has capacity to receive a coiled strip of dunnage.

16. The system as set forth in claim 1, further comprising a converter operable to convert a sheet stock material into the supply of strip-like dunnage, the converter having an outlet for dispensing a strip of the strip-like dunnage in a downstream direction towards the coiler.

17. A system as set forth in claim 16, further comprising a converter controller in communication with at least one sensor to activate the converter when the sensor indicates the tube has capacity to receive a coiled strip of dunnage.

18. A system as set forth in claim 16, wherein the sheet stock material is paper.

19. A system as set forth in claim 1, wherein the tube includes a coil tray adjacent the tube in the discharge direction for further holding and conveying of the coiled strip of dunnage from the tube.

20. A system as set forth in claim 19, wherein the coil tray is an axially extending portion of the tube remote from the coiler.

21. A system as set forth in claim 1, wherein the tube has a cylindrical wall defining the diameter of the tube.

22. A method of producing coiled dunnage, comprising the following steps:

coiling a strip of dunnage about a coiling axis; and axially displacing the coiled strip of dunnage into a tube to hold the coiled strip of dunnage in a coiled configuration.

23. The method as set forth in claim 22, further comprising detecting when the coiled strip of dunnage has been axially displaced.

24. The method as set forth in claim 22, further comprising detecting when a coiled strip of dunnage is removed from the tube.

25. The method as set forth in claim 22, further comprising coiling a strip of dunnage in response to a signal indicating that a coiled strip of dunnage has been removed from the tube.

26. The method as set forth in claim 22, further comprising detecting when a predetermined number of coiled strips of dunnage are being held in the tube.

27. The method as set forth in claim 22, further comprising controlling a converter operable to convert a sheet stock material into the strip-like dunnage in response to a signal indicating that the tube has capacity to receive a coiled strip of dunnage.

28. The method as set forth in claim 22, further comprising controlling the coiling of the strip of dunnage in response to a signal indicating that the tube has capacity to receive a coiled strip of dunnage.

* * * * *